US012721393B1

(12) United States Patent
Yakoubian

(10) Patent No.: US 12,721,393 B1
(45) Date of Patent: Sep. 1, 2026

(54) GARMENT MARKING SYSTEM

(71) Applicant: Talin K Yakoubian, Canoga Park, CA (US)

(72) Inventor: Talin K Yakoubian, Canoga Park, CA (US)

( * ) Notice: Subject to any disclaimer, the term of this patent is extended or adjusted under 35 U.S.C. 154(b) by 0 days.

(21) Appl. No.: 19/408,875

(22) Filed: Dec. 4, 2025

(51) Int. Cl.
*A41H 1/06* (2006.01)
*A41H 23/00* (2006.01)

(52) U.S. Cl.
CPC ..... *A41H 1/06* (2013.01); *A41H 23/00* (2013.01)

(58) Field of Classification Search
CPC ..... A41H 1/06; A41H 23/00
USPC ..... 33/9 A, 809
See application file for complete search history.

(56) References Cited

U.S. PATENT DOCUMENTS 1,490,483 A * 4/1924 Rose ..... A41H 9/02 33/9 R
1,538,305 A * 5/1925 Smith ..... A41H 9/02 33/9 A
1,581,350 A * 4/1926 Kimbler ..... A41H 9/02 33/9 A
1,609,061 A * 11/1926 Collins ..... A41H 9/02 33/9 A
2,242,071 A * 5/1941 Hoffman ..... A41H 9/02 227/140
2,272,612 A * 2/1942 Levin ..... A41H 9/02 33/9 A
2,319,722 A * 5/1943 Collins ..... A41H 9/02 33/9 R
2,433,082 A * 12/1947 Yechout ..... A41H 9/02 33/9 R
2,664,633 A * 1/1954 Reich ..... A41H 9/02 33/8
2,672,689 A * 3/1954 Politziner ..... A41H 9/02 33/9 A
4,050,159 A * 9/1977 Kakinuma ..... A41H 9/02 33/9 R
5,531,029 A 7/1996 Hawes
5,873,175 A * 2/1999 Johnston ..... G01B 3/08 33/783
8,875,408 B2 * 11/2014 Steffensen ..... G01C 15/06 33/809

OTHER PUBLICATIONS

Sewing Online Free Standing Chalk Hem Marker, Nov. 15, 2013, https://www.amazon.co.uk/gp/product/B00GOXC1CW/ref=as_li_qf_asin_il_tl?ie=UTF8&tag=halesmoore0d-21&creative=6738&linkCode=as2&creativeASIN=B00GOXC1CW&linkId=963d6eca43aec5bbe4fdc41d64654dcd (5 pages).

* cited by examiner

*Primary Examiner* — George B Bennett
(74) *Attorney, Agent, or Firm* — Plager Schack LLP; Mark H. Plager; Naomi Mann

(57) ABSTRACT

A garment marking system is disclosed comprising a compact, height-adjustable apparatus combining a telescoping ruler and a detachable marking assembly. The marking assembly includes a replaceable powder container, a hose-connected air pump, and an outlet for expelling marking powder onto garments. A clamping bracket allows the marking head to slide vertically along the ruler for precise marking at various heights. The system provides easy operation, color-changing convenience, and portability for tailoring and alteration applications.

13 Claims, 3 Drawing Sheets

GARMENT MARKING SYSTEM

BACKGROUND

The present disclosure relates generally to devices and systems for marking garments and, more particularly, to a measuring and marking apparatus for tailoring, clothing alterations, and other precision marking applications.

SUMMARY

According to various embodiments, a garment marking system is provided that combines a length-adjustable measuring ruler with a marking assembly comprising a changeable powder container. The marking assembly dispenses material contained in the powder container through a hose-connected applicator, enabling accurate and clean garment marking without the need for large stands or manual chalk handling. The system is compactable for travel, provides color-changing convenience through interchangeable powder containers, and ensures marking consistency at adjustable heights.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
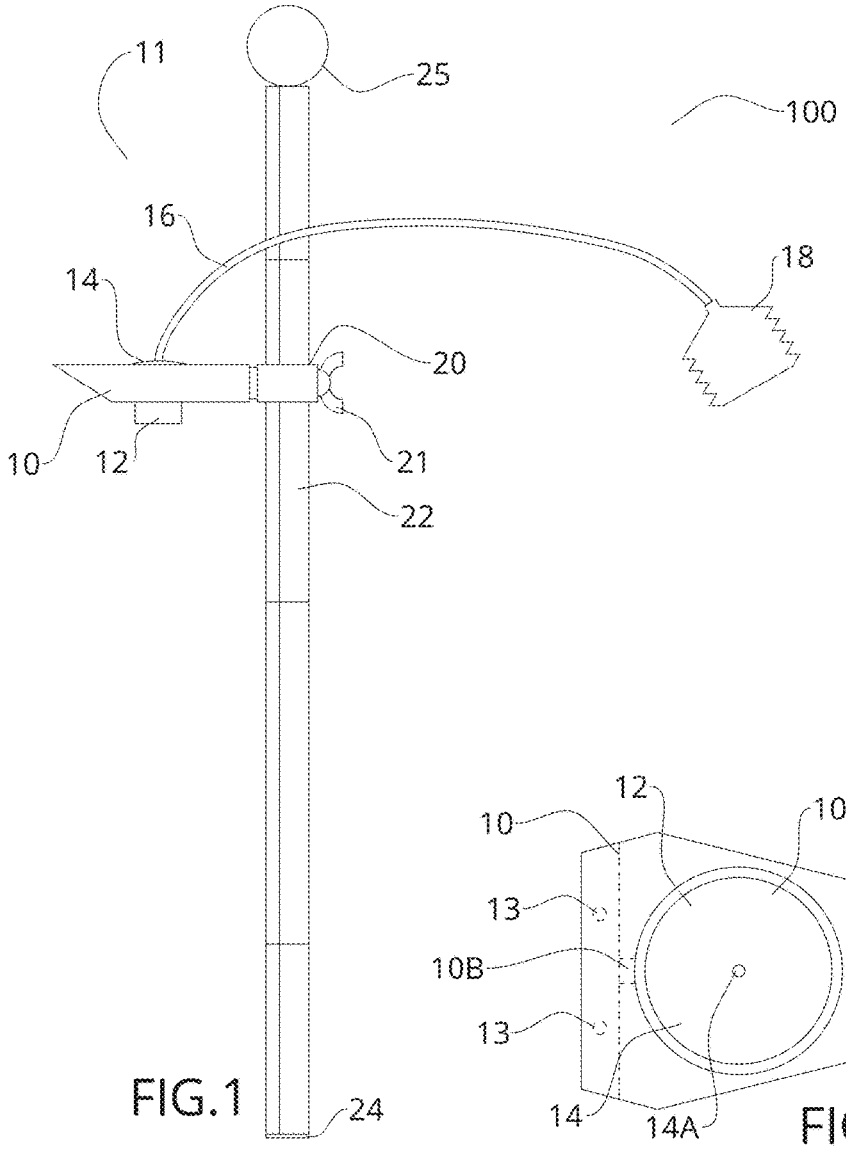
FIG. 1 depicts a garment marking and measuring apparatus, according to various embodiments.
Figure 2:
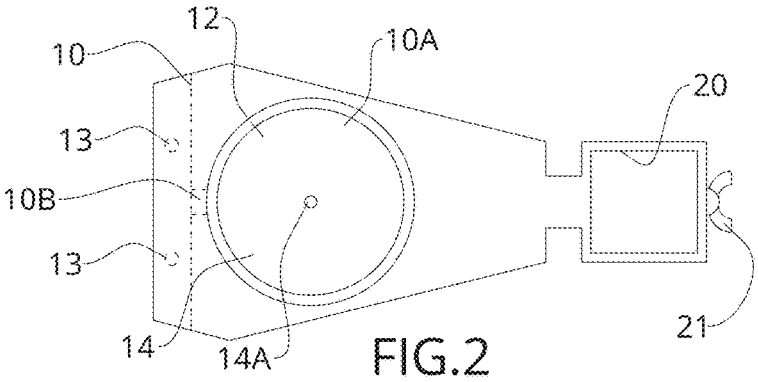
FIG. 2 is a top view of a marking head of the apparatus.
Figure 3:
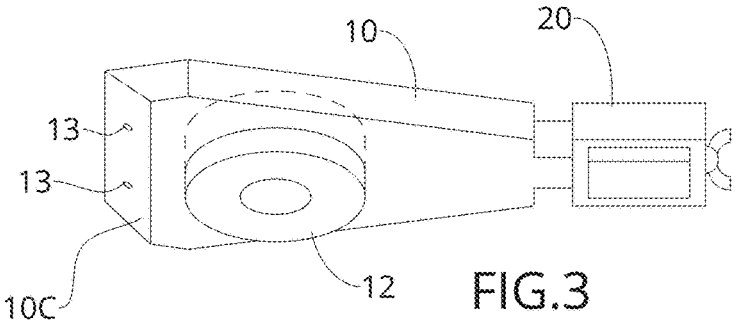
FIG. 3 is a bottom perspective view of a marking head of the apparatus.
Figure 4:
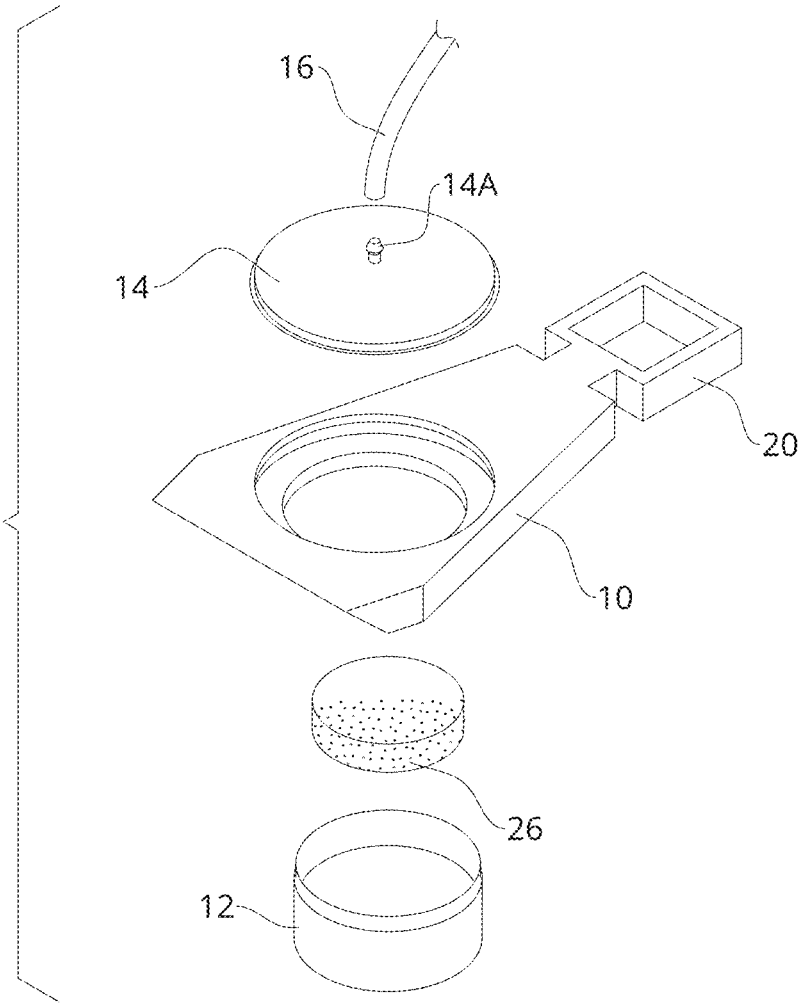
FIG. 4 is an exploded view of the marking head.
Figure 5:
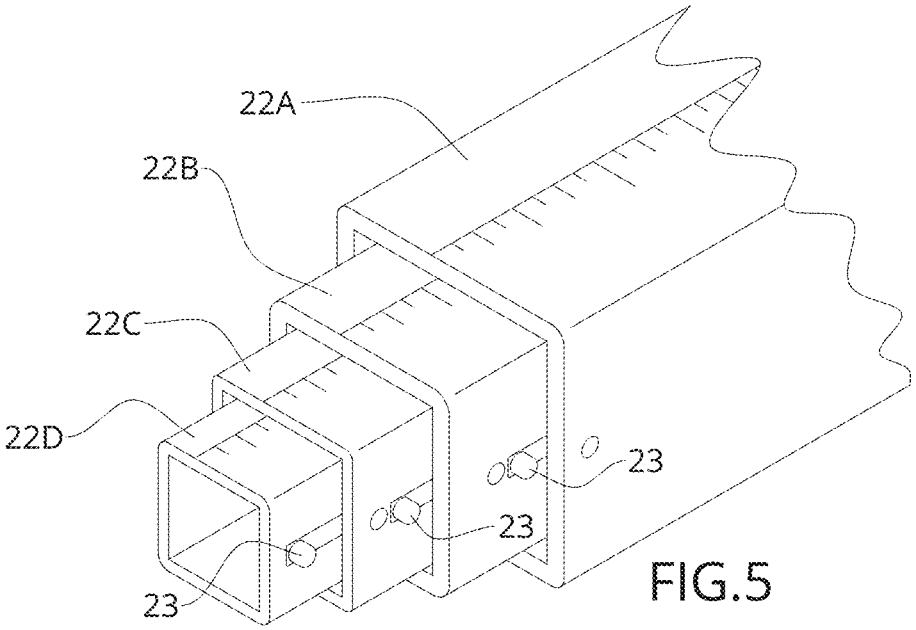
FIG. 5 is a detailed view of a telescoping ruler of the apparatus, according to certain embodiments.
Figure 6:
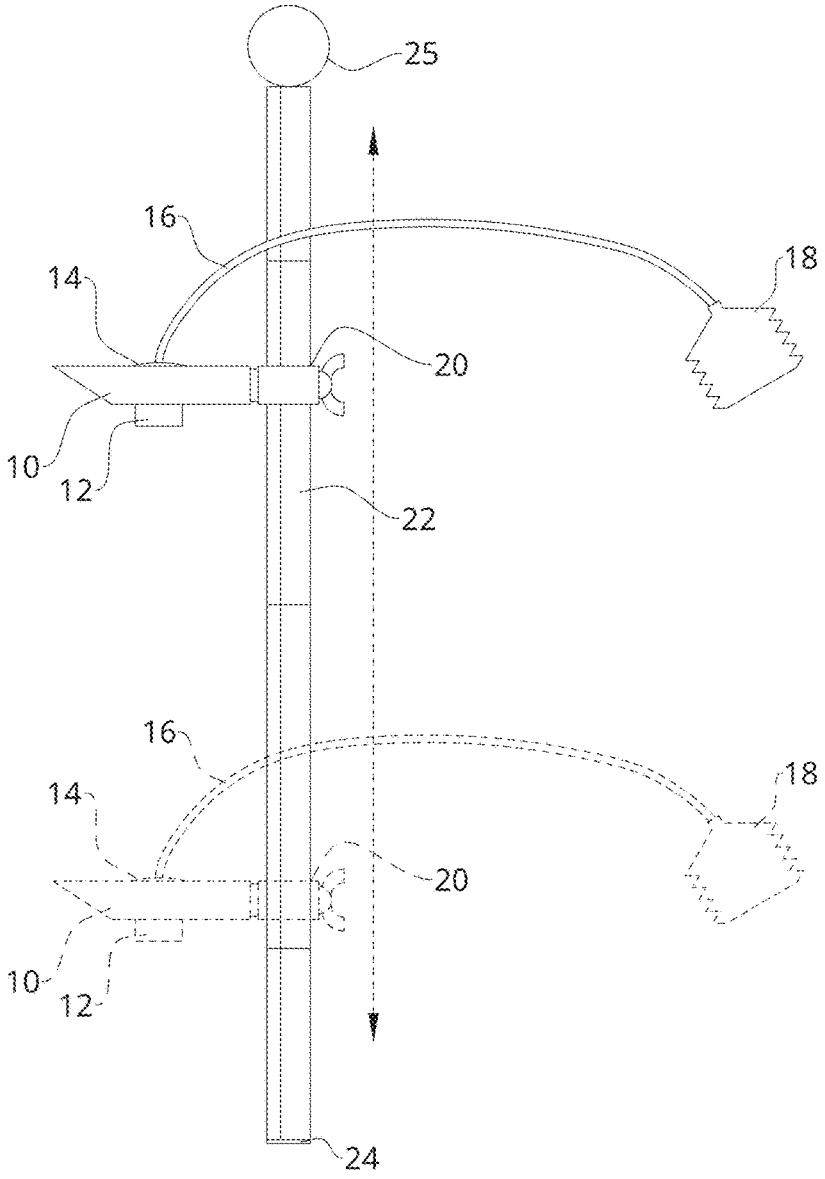
FIG. 6 is a schematic view of the apparatus showing telescopic motion of the ruler.
Figure 7:
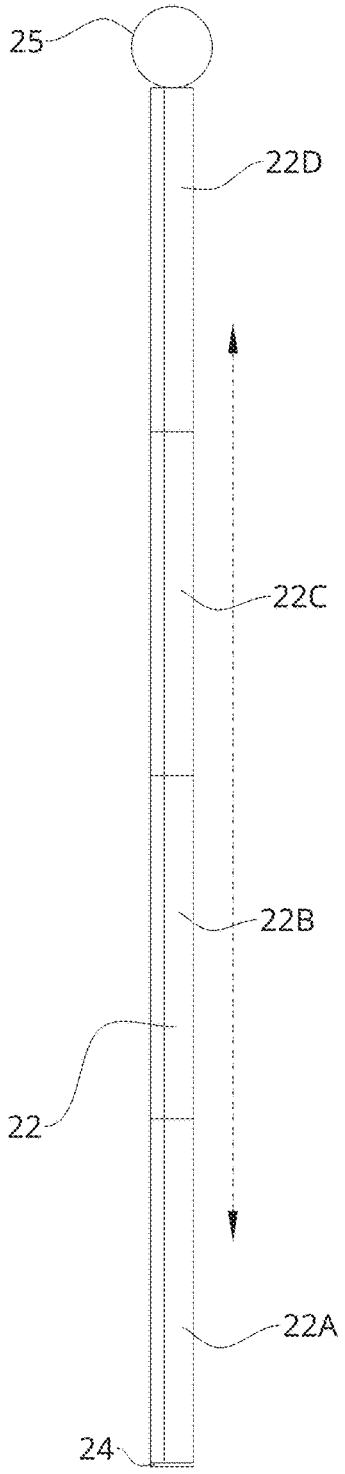
FIG. 7 is a schematic view of the ruler in an expanded position.

According to various embodiments illustrated in FIGS. 1-7, a garment marking system is provided that includes a compactable measuring and marking apparatus 100. In certain embodiments, the marking apparatus 100 comprises a length-adjustable ruler 22 and a marking assembly 11 coupled to the ruler 22 by a clamping bracket 20. The marking assembly 11 includes a marking head 10 configured to support a replaceable powder container 12, which is removably attached to a lower end of the marking head, and a hose connector cap 14 secured to an upper end of the marking head. The cap 14 defines an opening 14A to which a first end of a hose 16 is connected. A second end of the hose 16 is connected to a pump 18, for enabling the pump to force air into powder container 12, such that chalk or other powder in container 12 may be expelled from one or more side holes 13 in marking head 10 for marking a garment or other item. In some embodiments, a hose connector or nipple may be provided at the opening 14A to facilitate attachment to the hose 16.

In certain embodiments, marking head 10 may comprise an opening 10A, which supports an attachment of both changeable powder container 12 and hose connector cap 14.

In some embodiments, powder container 12 is attached through a lower end of opening 10A and cap 14 is attached at an upper end over container 12. In some embodiments, the attachment of powder container 12 and connector cap 14 may be air tight. In further embodiments, an internal channel 10B which extends between opening 10A and a marking outlet 10C may be formed within marking head 10 and is configured to allow powder to flow from container 12 to outlet 10C and exit through holes 13 of the outlet. In some embodiments, cap 14 may be configured to securely seal opening 10A to keep the powder in place while allowing smooth airflow and powder dispensing during use. Both cap 14 and container 12 may be spaced apart so as to not block internal channel 10B. According to an exemplary embodiment, the diameters of opening 10A, container 12, and cap 14 may be about 1.25 inches; however different sizes and dimensions may be used in alternate embodiments. In one embodiment, powder container 12 may include external threading for engagement with internal threading of opening 10A. However, other attachment methods, such as a snap fit and/or friction fit mechanism may be used in alternate embodiments.

Powder container 12 may comprise powder such as chalk, or other pigmented or unpigmented powder suitable for marking the intended item. As powder container 12 is removable, it may easily be exchanged for powder of a different color, by simply screwing out one container and replacing it with another. In certain embodiments, the disclosed system provides multiple containers 12, each containing a different color of powder, which are exchangeable within marking head 10. Each container may include a threaded sealing cap that is removed prior to installation within marking head 10.

In some embodiments, hose connector cap 14 may likewise be removable with respect to through opening 10A, e.g., via a threaded engagement or snap fit, and the like. In other embodiments, hose connector cap 14 may be permanently attached to marking head 10. Pump 18 may be an accordion style hand pump configured to pump air into container 12 via hose 16 for application to the item being marked. Hose 16 is ideally lightweight and flexible, making it easy to maneuver during use. It is further configured to snuggly fit into an outlet end of pump 18, and the cap/nipple in opening 14A for a sealed airflow system. According to an exemplary embodiment, hose 16 may be made of a plastic material and is about 24 inches long and ¼ of an inch in outer diameter with a thickness of about ⅛ of an inch. Pump 18 may be about 2 inches long and about 1.5-2 inches wide, and is likewise made of a plastic material.

In certain embodiments, ruler 22 includes length marking indications, which may be in any known standard measurement system. In one embodiment, one side of ruler 22 may be marked according to the International System of Units (SI) (i.e., millimeters, centimeters), and the other side may be marked according to the US customary system (i.e., inches, feet). In further embodiments, ruler 22 may be configured to expand and retract for size adjustment. In one embodiment, ruler 22 may comprise multiple telescoping/nested sections (e.g., 22A, 22B, 22C, and 22D) made of aluminum, plastic, or other suitable material. In some embodiments, each section may include marking measurements, which may be provided on opposite sides of the respective section. In one example, the marking measurements are continuous from the lower to the upper section. A sprig arm 23 may be coupled to a wall of each nested section which provides friction that enables the section to remain in a fixed position when extend and retracted. This allows for multiple size adjustments of the ruler and enables marking apparatus 100 to be easily used for marking both top and garment pieces, while being compactable for travel and storage. In one embodiment, ruler 22 may have an overall square cross section, and is adjustable between about 8 inches to about 72 inches, or between about 10 inches and about 60 inches; and is thus configured to mark from a half inch above floor level to up to 72 inches. In some embodiments, a hanging member 25 such as a ring or hook, may optionally be provided at the top end of ruler 22. Ideally, hanging member 25 has a flat profile which is flush with a side of ruler 22 to enable ruler to sit flatly against a wall when hung.

In some further embodiments, a foot member 24 made of rubber or other high friction material may be provided on a bottom end of ruler 22 for enabling it to position firmly on a surface without slippage. Foot member 24 prevents twisting, slipping, or floor damage during use, and helps the ruler remain stable and accurate. Additionally, foot member 24 provides a flat surface area so that ruler 22 may be held at a leveled and vertically perpendicular orientation when being held by a user. The geometric shape of foot member 24 may be for example, square, rectangular, or circular, but is not limited to these options. In some embodiments, ruler 22 may have a square cross section as depicted in the figures but is not limited to this option. According to an exemplary embodiment, foot member 24 may have a square shape configured to cap the bottom of ruler 22, and is about ⅛ of an inch thick.

In certain embodiments, clamping bracket 20 is position adjustable, i.e., slidable, along the vertical length of ruler 22, and is coupled to marking head 10, so that the position of marking assembly 11 may be vertically adjusted along the length of ruler 22. In some embodiments, clamping bracket 20 and marking head 10 may be a unitary piece, but not necessarily so. In some embodiments, clamping bracket 20 is made of a high friction material such as rubber, and is configured to surround and grip the ruler. In further embodiments, clamping bracket 20 may include a locking component 21, such as a butterfly screw that can be loosened to release marking assembly 11 for position adjustment, and tightened lock the position of marking assembly 11 with respect to ruler 22. In alternate embodiments, a spring latch or other locking component may be used instead of the butterfly screw.

Marking apparatus 100 may be used for marking garments for alterations by adjusting the length of ruler 22 based on the height of the marking location. Ruler 22 may simply be held down and leveled on a floor surface using one hand, and without a stand and complex set-up procedure. Marking head 10 may be positioned proximate the intended marking location, with marking outlet 10C facing the item (i.e., garment) to be marked, and pump 18 may be actuated to expel the marking powder onto the item. The system enables a user to change container 12 so that the marking color can be selected based on user preference. It shall be appreciated that marking apparatus 100 may be used in other projects which require marking, such as painting, drawing, construction work, home repair, etc. It shall be appreciated that the disclosed system may incorporate other components, such as a travel case/box for apparatus 100, other optional tailoring tools which may be included in the travel case as a kit, an optional support stand, etc.

The disclosed system thus provides a marking apparatus which is sturdy, compactable, and fast and easy to use for taking measurements and garment marking, with color-changing convenience. It shall be appreciated that the disclosed system and/or components of marking apparatus 100 may have different configurations in alternate embodiments. It shall be appreciated that the components of marking apparatus 100 may comprise any alternative known materials in the field and be of any size and/or dimensions. It shall be appreciated that the components of marking apparatus 100 may be manufactured and assembled using any known techniques in the field.

It shall be understood that the orientation or positional relationship indicated by terms such as "upper", "lower", "front", "rear", "left", "right", "top", "bottom", "inside", "outside" is based on the orientation or positional relationship shown in the accompanying drawings, which is only for convenience and simplification of describing the disclosed subject matter, rather than indicating or implying that the indicated device or element must have a specific orientation or are constructed and operated in a specific orientation, and therefore should not be construed as a limitation of the present invention.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A garment marking apparatus comprising:

a length-adjustable ruler;

a marking assembly coupled to the length-adjustable ruler via a clamping bracket, the marking assembly including a marking head having a replaceable powder container removably attached to a lower end of the marking head;

a cap attached to an upper end of the marking head, the cap defining an opening;

a hose having a first end connected to the opening of the cap and a second end connected to a hand pump;

wherein actuation of the hand pump forces air into the powder container to expel powder through at least one outlet of the marking head for marking a garment, wherein the length-adjustable ruler further comprises a foot member at a bottom end thereof, the foot member being made of a high-friction material to prevent slippage, wherein the foot member comprises a low-profile, compact member having a flat surface area, and is configured to stabilize the ruler in a vertically perpendicular orientation on a floor surface while the ruler is manually supported by a user without use of a stand.

2. The garment marking apparatus of claim 1, wherein the clamping bracket is vertically adjustable along the length-adjustable ruler and includes a locking component for securing the marking assembly in position.

3. The garment marking apparatus of claim 1, wherein the length-adjustable ruler comprises multiple telescoping sections, each including measurement indicia.

4. The garment marking apparatus of claim 3, wherein the measurement indicia are in both metric and U.S. customary systems.

5. The garment marking apparatus of claim 4, wherein the telescoping sections have a square cross section, and wherein the measurement indicia is provided on opposite sides in each section.

6. The garment marking apparatus of claim 1, wherein the powder container is removably coupled to the marking head via a threaded, snap-fit, or friction-fit connection within an opening in the marking head.

7. The garment marking apparatus of claim 6, wherein the cap is coupled to the marking head via a permanent, threaded, snap-fit, or friction-fit connection within the opening in the marking head, and above the powder container.

8. The garment marking apparatus of claim 1, wherein the powder container contains chalk or other marking powder configured to be expelled through one or more side holes in the marking head.

9. The garment marking apparatus of claim 1, wherein the hand pump is an accordion-style hand pump configured to deliver air through the hose to the powder container.

10. The garment marking apparatus of claim 1, wherein the length-adjustable ruler further comprises a foot member at a bottom end, the foot member being made of a high-friction material to prevent slippage.

11. The garment marking apparatus of claim 1, further comprising a hanging member at an upper end of the length-adjustable ruler for storage.

12. The garment marking apparatus of claim 1, wherein the marking head further includes an internal channel extending between the cap and the at least one outlet to allow powder flow from the container to the at least one outlet.

13. The garment marking apparatus of claim 1, wherein the apparatus is compactable for travel and storage, and configured to mark at adjustable heights between approximately 8 and 72 inches above a floor surface.

* * * * *